US006074222A

United States Patent [19]

Kuo

[11] Patent Number: 6,074,222

[45] Date of Patent: Jun. 13, 2000

[54] CABLE END CONNECTOR

[75] Inventor: Peter Kuo, Taipei, Taiwan

[73] Assignee: Hon Hai Precision Ind. Co., Ltd., Taipei Hsien, Taiwan

[21] Appl. No.: 09/416,487

[22] Filed: Oct. 12, 1999

[30] Foreign Application Priority Data

Jun. 1, 1999 [TW] Taiwan ..... 88208873

[51] Int. Cl.[7] ..... H01R 4/66

[52] U.S. Cl. ..... 439/92; 439/939

[58] Field of Search ..... 439/92, 607–610, 439/939

[56] References Cited

U.S. PATENT DOCUMENTS

| | | | |
|---|---|---|---|
| 5,178,562 | 1/1993 | Ermini | 439/939 |
| 5,709,569 | 1/1998 | Buck et al. | 439/607 |
| 5,838,550 | 11/1998 | Morris et al. | 439/939 |
| 5,865,646 | 2/1999 | Ortega et al. | 439/939 |
| 5,913,698 | 6/1999 | Keng | 439/939 |
| 5,957,726 | 9/1999 | Belopolsky et al. | 439/607 |
| 6,005,186 | 1/1993 | Bachman | 439/939 |

*Primary Examiner*—Gary F. Paumen
*Attorney, Agent, or Firm*—Wei Te Chung

[57] ABSTRACT

A cable end connector comprises a metal shell and an insulative housing. A pair of locking elements is formed at lateral sides of the housing. A mating slot is formed in the mating side of the housing. A projection extends from the housing into the mating slot. A plurality of receiving slots is formed in the projection of the housing for receiving a plurality of terminals therein. A pair of locking holes is formed at lateral sides of the metal shell for engaging with the corresponding locking elements. A pair of grounding plates is soldered at lateral sides of the metal shell. Each grounding plate has a solder portion and a contacting portion, the solder portion being soldered to the metal shell, the contacting portion providing electrical contact with a metal panel. An opening is formed between the solder portion and the contacting portion for enhancing the resilience of the grounding plate.

2 Claims, 6 Drawing Sheets

CABLE END CONNECTOR

BACKGROUND OF THE INVENTION

The present invention relates to a cable end connector, and particularly to a cable end connector having a grounding plate for reliably discharging static electricity accumulated thereon.

Cable end connectors are widely used in the computer industry, and are generally fixed to a rear panel of a computer enclosure to engage with a corresponding electrical connector. A grounding plate is arranged in the connector for electrically contacting the rear panel of the computer, thereby grounding the static electricity accumulated in the connector. A gap is often present between the grounding plate and the metal panel as a result of manufacturing tolerance and assembling process deficiencies. Thus, the grounding plate does not make electrical contact with the metal panel, and a build up of static electricity can adversely affect the signal transmission of the connector. Related inventions are disclosed in U.S. Pat. Nos. 344,492 and 5,709,569 and Taiwan Patent Application No. 86102088.

Referring to FIG. 1, a conventional cable end connector 7 is connected to the end of a cable 8. A cover 80 surrounds the connector 7, and a grounding plate 70 is formed on the end of the connector 7 for electrically contacting a metal panel 9. The metal panel 9 forms an opening 90 for receiving the connector 7. When the connector 7 engages with the opening 90, the grounding plate 70 contacts the metal panel 9 for grounding static electricity accumulated in the connector 7. However, sometimes a gap T between the grounding element 70 and the metal panel 9 is formed during the assembly process, and the grounding plate 70 fails to connect to ground, thus allowing accumulated static electricity to adversely affect signal transmission. A more reliable grounding mechanism for cable end connector is desired.

BRIEF SUMMARY OF THE INVENTION

A main object of the present invention is to provide a cable end connector having a pair of grounding plates which reliably contacts a metal panel for grounding static electricity accumulated on the connector.

Another object of the present invention is to provide a cable end connector having a pair of grounding plates which is soldered to a metal shell of the conventional connector for saving production cost.

To achieve the above-mentioned objects, a preferred embodiment of the present invention comprises a metal shell and an insulative housing. A pair of locking elements is formed at lateral sides of the housing, and a pair of corresponding locking holes is formed in the metal shell for engaging with the locking elements. A mating slot is formed in the mating direction of the housing. A projection extends from the housing and the projection is formed in the mating slot. A plurality of receiving slots is formed in the projection for receiving a plurality of terminals therein. A pair of grounding plates is soldered to lateral sides of the metal shell, each grounding plate having a solder portion and a contacting portion, the solder portion being soldered to the metal shell, the contacting portion making electrical contact with a metal panel. An opening is formed between the solder portion and the contacting portion of each grounding plate for adding resiliency. Soldering the plate to the shell achieves production efficiency.

Other objects, advantages and novel features of the invention will become more apparent from the following detailed description when taken in conjunction with the accompanying drawings.

DETAILED DESCRIPTION OF THE INVENTION

Figure 1:
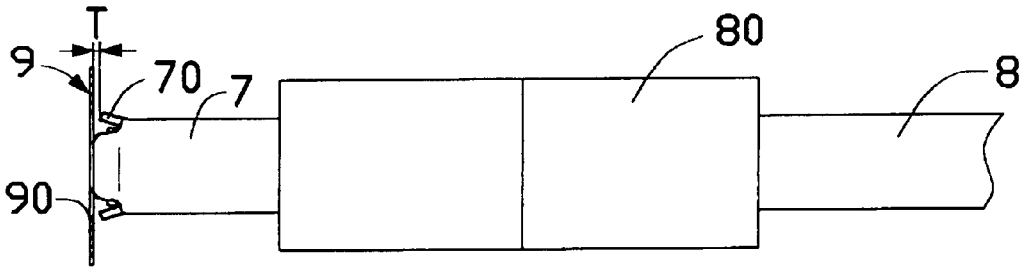
FIG. 1 (PRIOR ART)
FIG. 1 is a side view of a conventional electrical connector and a metal panel of a computer.
Figure 2:
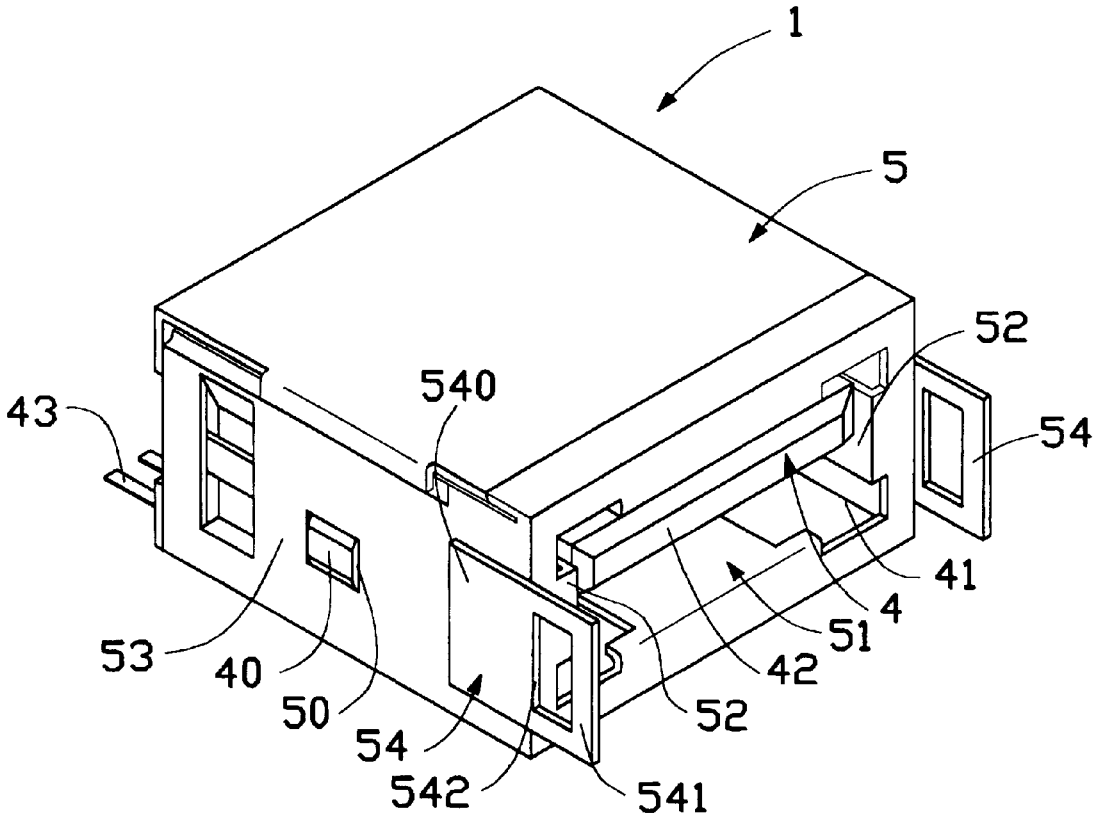
FIG. 2 is an assembled view of a cable end connector in accordance with the present invention.
Figure 4:
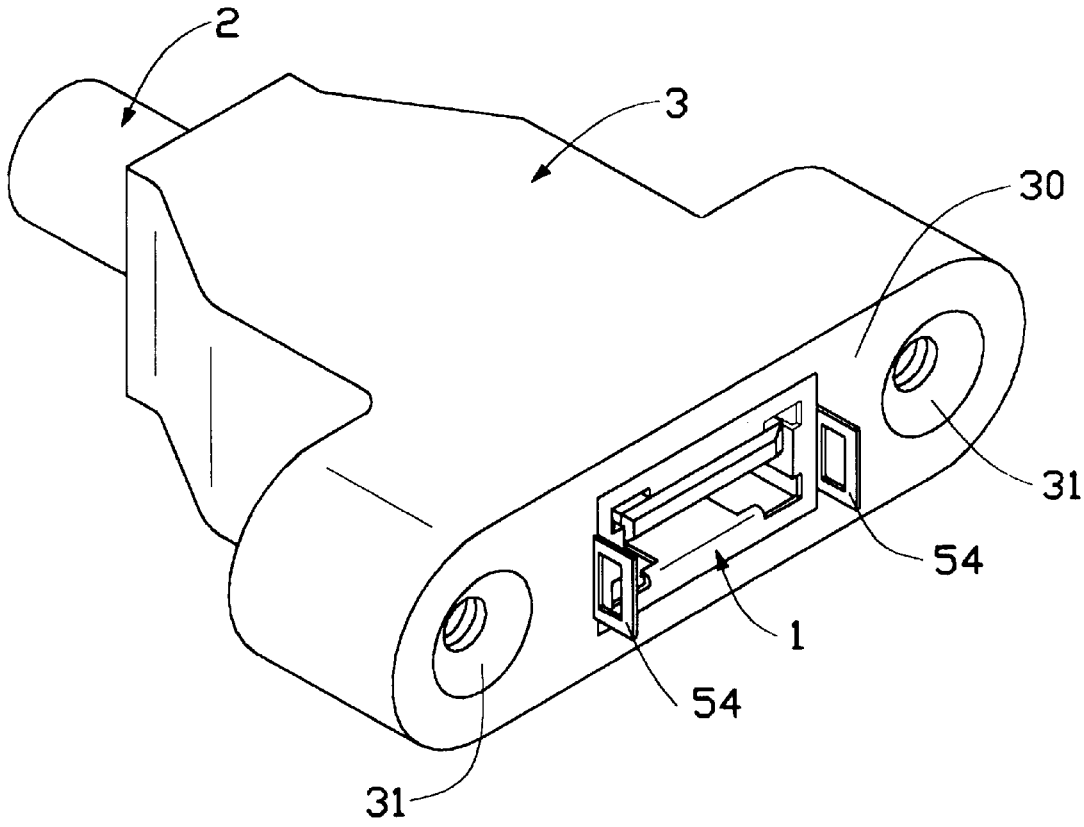
FIG. 4 is a perspective view of the cable end connector assembled with a round cable.

Referring to FIGS. 2 and 4, a cable end connector 1 is received in a receiving space formed by a cover 3 and connected with a round cable 2 for mating with an external connector (not shown). The connector 1 comprises a metal shell 5 and an insulative housing 4. A pair of locking elements 40 is formed at lateral sides of the housing. A mating slot 41 is formed in the mating direction of the housing 4. A projection 42 extends from the housing 4 and is received in the mating slot 41. A plurality of receiving slots (not shown) is formed in the projection 42 of the housing 4 for receiving a plurality of terminals 43 therein.

The shell 5 forms an opening 51 in a front portion thereof, and a pair of clip plates 52 is formed at lateral inner sides of the opening for providing a spring force to engage with a mating connector. A second opening (not shown) is formed in a rear portion of the shell 5 opposite the opening 51 for receiving the terminals 43 extending therethrough. A pair of locking holes 50 is formed at lateral sides of the metal shell 5 for engaging with the corresponding locking elements 40. A pair of grounding plates 54 is soldered on lateral side walls 53 of the shell 5. The grounding plate 54 is made of a thin copper plate, thus the grounding plate 54 is more resilient than the shell 5, which is made of a thicker copper plate. The grounding plate 54 comprises a solder portion 540 and a contacting portion 541. The solder portion 540 is soldered to the side wall 53 of the shell 5. An opening 542 is formed between the solder portion 540 and the contacting portion 541 to give the grounding plate appropriate resiliency.

Figure 3:
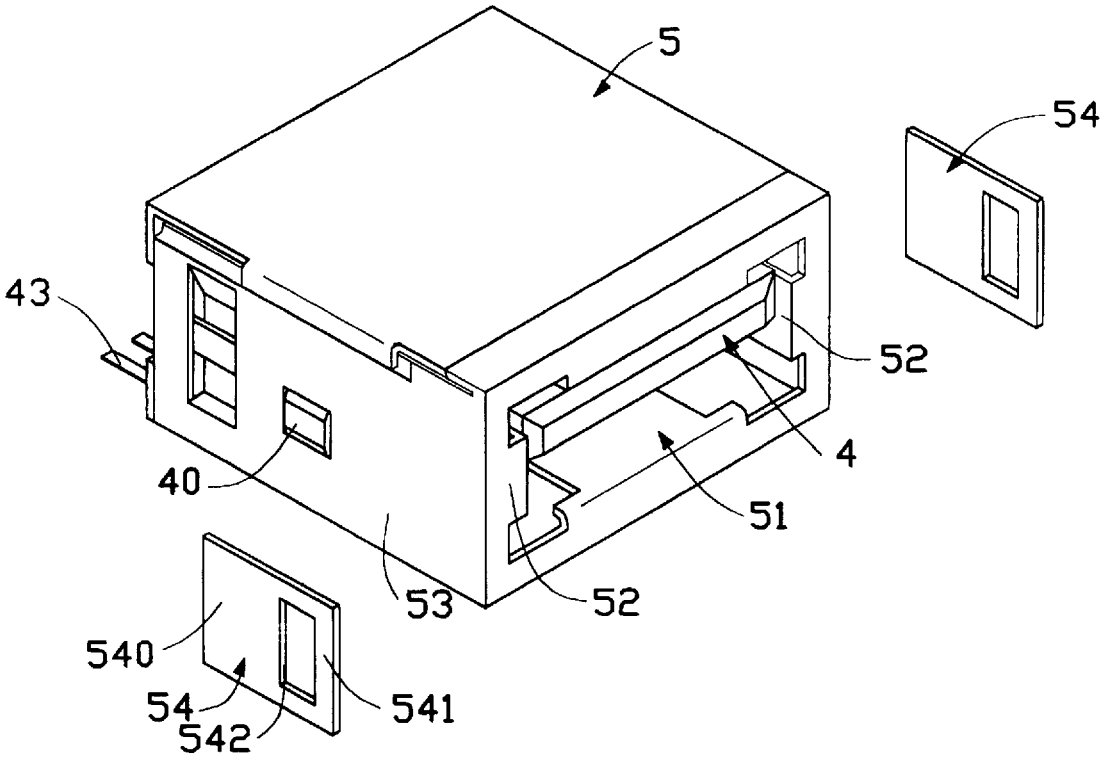
FIG. 3 is a perspective view of the cable end connector and a pair of grounding elements.
Figure 5:
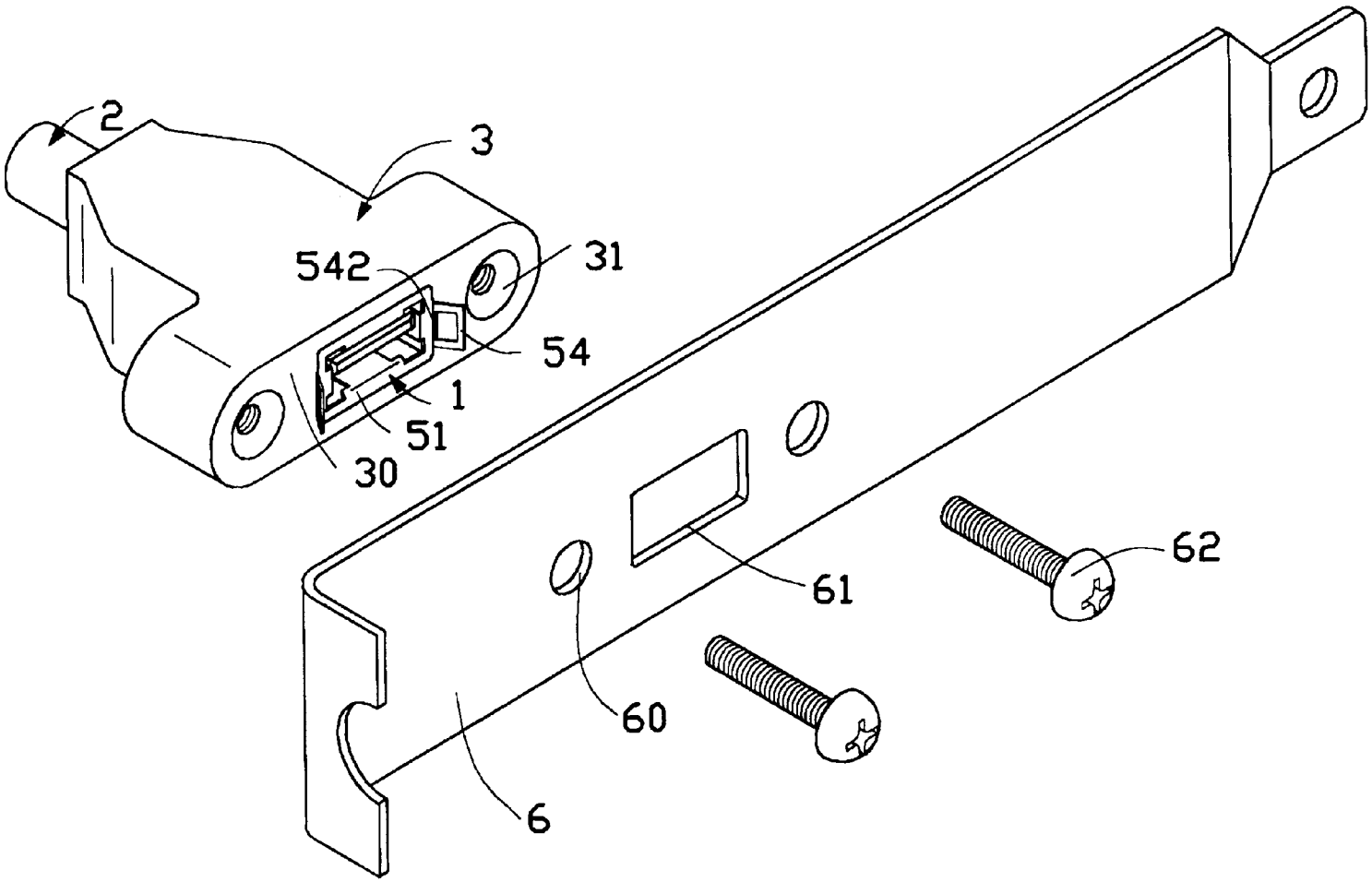
FIG. 5 is a perspective view of the cable end connector and a metal panel of an enclosure of a computer.

Referring to FIGS. 3 and 5, the grounding plate 54 is stamped from a thin copper plate. After the cable end connector 1 is assembled in the cover 3, the grounding plates 54 are folded outwardly to assure a reliable contacting with the metal panel 6. The metal panel 6 has a pair of receiving holes 60 for receiving a pair of screws 62 which are used to engage with corresponding fixing holes 31 in the cover 3. An opening 61 is formed in the metal panel 6 for receiving a mating connector therein.

Figure 6:
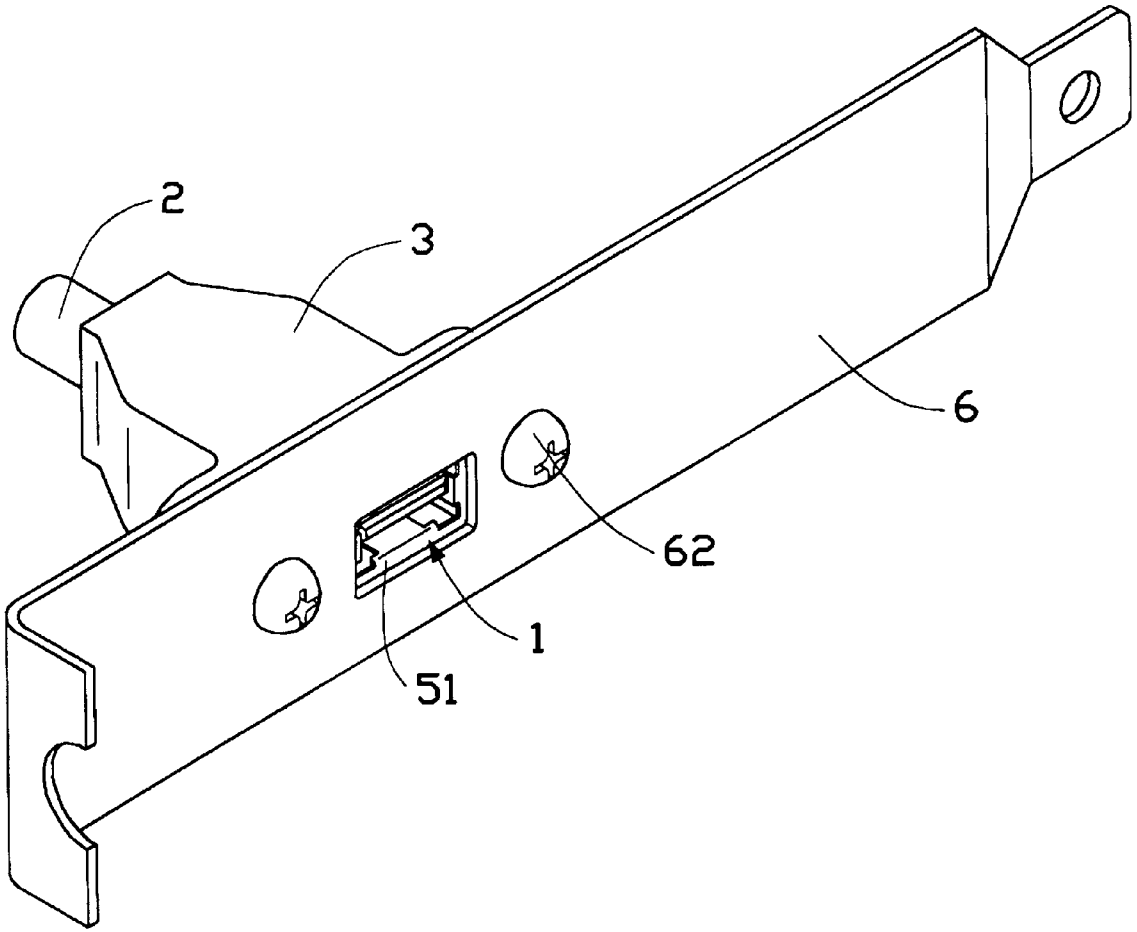
FIG. 6 is a perspective view of the cable end connector assembled with the metal panel.

Referring to FIG. 6, when the cable end connector 1 is assembled with the metal panel 6, the screws 62 are engaged with the fixing holes 31, fixing the metal panel 6 to the connector 1, and the grounding plates 54 electrically contact the metal panel 6, thereby dissipating static electricity accumulated on the connector 1.

Additionally, soldering the grounding plate 54 to the metal shell 5 provides a metal grounding mechanism while saving production cost.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable end connector assembly comprising:

a cover defining a receiving space and a pair of fixing holes formed in lateral ends of the cover;

an insulative housing received in the receiving space and comprising a mating slot, a projection formed in the mating slot and a pair of locking elements formed at lateral sides of the housing, the projection forming a plurality of receiving slots;

a plurality of terminals received in the corresponding receiving slots;

a metal shell defining an opening at a front side thereof for receiving a mating connector therein, a pair of locking holes being formed at lateral sides of the metal shell for engaging with the corresponding locking elements of the housing, the metal shell fitting around the housing and being received in the receiving space; and a pair of grounding plates each having a solder portion soldered to the metal shell and a contacting portion for electrically contacting a metal panel, wherein after assembly the grounding plate is folded outwardly for facilitating the contacting with the metal panel;

wherein an opening is defined in each grounding plate for added resilience.

2. A cable end connector assembly comprising:

a cover defining a receiving space and a pair of fixing holes formed in lateral ends of the cover;

a connector being received within the receiving space, said connector including an insulative housing and a metal shell, said housing defining a mating slot with a plurality of terminals positioned therein, said metal shell defining a first opening in alignment with the mating slot, said metal shell surrounding the insulative housing;

a metal panel fastened to said cover with a second opening in alignment with said first opening;

a pair of clip plates backward folded from two opposite inner lateral sides of the opening of the metal shell into the mating slot; and a pair of separate grounding plates respectively soldered to the metal shell, each of said grounding plates extending laterally outwardly, and mechanically and electrically engaged with the metal panel around the first opening; wherein;

wherein said cover and said metal panel are assembled by a pair of screws horizontally aligned with and sandwiching therebetween the pair of grounding plates.

the clip plates and the grounding plates are positioned at the same level.

* * * * *